US006975062B2

(12) United States Patent
Suzuki et al.

(10) Patent No.: US 6,975,062 B2
(45) Date of Patent: Dec. 13, 2005

(54) SPARK PLUG WITH POWDER FILLING

(75) Inventors: Hirofumi Suzuki, Kuwana (JP); Yasushi Kawashima, Mie-ken (JP)

(73) Assignee: Denso Corporation, (JP)

( * ) Notice: Subject to any disclaimer, the term of this patent is extended or adjusted under 35 U.S.C. 154(b) by 102 days.

(21) Appl. No.: 10/345,174

(22) Filed: Jan. 16, 2003

(65) Prior Publication Data

US 2004/0222728 A1 Nov. 11, 2004

(30) Foreign Application Priority Data

Jan. 17, 2002 (JP) ..... 2002-009036
Nov. 19, 2002 (JP) ..... 2002-335550

(51) Int. Cl.[7] ..... H01T 13/02
(52) U.S. Cl. ..... 313/132; 313/118; 313/143
(58) Field of Search ..... 313/132, 137, 313/118, 143, 145

(56) References Cited

U.S. PATENT DOCUMENTS 5,508,582 A * 4/1996 Sugimoto et al. ..... 313/118
6,130,498 A 10/2000 Shimizu et al. ..... 313/141
6,265,816 B1 * 7/2001 Ito et al. ..... 313/141
6,366,008 B1 * 4/2002 Fukushima et al. ..... 313/141

FOREIGN PATENT DOCUMENTS

| | | |
|---|---|---|
| EP | 1168544 A1 | 1/2002 |
| JP | 64-2384 | 1/1989 |
| JP | 64-8439 | 2/1989 |
| JP | 11-242982 | 9/1999 |
| JP | 2002-83664 | 3/2002 |

* cited by examiner

*Primary Examiner*—Joseph Williams
*Assistant Examiner*—Kevin Quarterman
(74) *Attorney, Agent, or Firm*—Nixon & Vanderhye PC

(57) ABSTRACT

In a spark plug for an internal combustion engine, an insulator is vided at its inside with a center electrode. A tubular housing is disposed to surround an outer periphery of the insulator. An annular space portion is provided between the housing and the outer periphery of the insulator. A powder filling is filled in the annular space portion so as to be formed as a filled portion therein. The powder filling is composed of a plurality of filling grains. 80 weight percent and over of the filling grains, before the powder filling is filled in the annular space, have a range from 100 to 1000 $\mu$m in grain diameter, respectively.

16 Claims, 13 Drawing Sheets

| | |
|---|---|
| □ 2 ~ 20 | COMPARATIVE EXAMPLE 1 |
| ○ 2 ~ 1000 | COMPARATIVE EXAMPLE 2 |
| ⊗ 70 ~ 500 | EXAMPLE 1 |
| △ 70 ~ 710 | EXAMPLE 2 |
| ▲ 125 ~ 1000 | EXAMPLE 3 |
| ◍ 210 ~ 710 | EXAMPLE 4 |
| ● 250 ~ 1000 | EXAMPLE 5 |

SPARK PLUG WITH POWDER FILLING

BACKGROUND OF THE INVENTION

1. Field of the Invention

The present invention relates to a spark plug for internal combustion engines used for vehicles, co-generation systems, gas transfer pumps or the like.

2. Description of the Related Art

A spark plug for internal combustion engines installed in vehicles, co-generation systems or the like has used in severe environments so that the spark plug requires high airtight structure and strength that resists severe oscillations under elevated temperatures.

As an example of the spark plug, there is disclosed a spark plug in Japanese Utility Model No. S64-2384. In the spark plug disclosed in the Utility Model, an annular space portion is disposed between a housing and an insulator, and powder filling is filled in the annular space portion to form a filled portion for improving airtightness of the spark plug. In addition, in the spark plug, a sleeve of the housing is caulked.

In the spark plug, the filled portion in which the powder filling is filled compensates difference of thermal expansion between the housing and the insulator to keep the airtightness therebetween and hold the insulator.

As conventional powder filling, granulated powder grains are used. The granulated powder grains are manufactured as follows. That is, raw powder particles are prepared and organic component such as binder solution is added to the raw powder particles. The raw powder particles to which the binder solution is added are mixed with each other to be granulated and sized so that the granulated powder grains are manufactured.

For example, the raw powder particles each of which has 50 $\mu$m or less in grain diameter are granulated in the above manner so that granulated powder grains each having 100 $\mu$m and over in grain diameter are manufactured.

However, in the conventional spark plug, when using the conventional spark plug under environmental conditions with elevated temperatures and severe oscillations, the airtightness and the strength of each of the granulated powder grains are decreased with time so that it may be difficult that the conventional spark plug keeps the function in itself.

That is, in the conventional spark plug, the granulated powder grains are manufactured by mixing the raw powder particles and the organic component such as the binder solution. Each of the granulated powder grains involves air at the granulating process so as to have a wholly porous shape.

Therefore, even when pressing the powder filling each grain of which has a wholly porous shape to be filled in the annular space portion, the filled portion has a plurality of gaps between each of the grains of the powder filling, causing the airtightness of the spark plug to be easily decreased, and the mechanical strength thereof to be easily weakened.

In addition, because of adding the organic component such as binder solution to the raw powder particles so as to manufacture the powder filling including the organic component, in a case of using the spark plug including the powder filling composed of granulated powder grains under elevated temperatures for a long period, the organic component in the powder filling volatilizes, causing pore rate in the powder filling to be increased.

The increase of the pore rate in the powder filling causes the airtightness of the filled portion to be decreased with time and/or the mechanical strength thereof to be weakened with time.

The holding strength of the filled portion with respect to the insulator, filled portion that is composed of the powder filling having low density, is decreased so that, when installing the spark plug in an engine, a top portion of the insulator may be pried with a plug wrench, causing a crack of the insulator.

SUMMARY OF THE INVENTION

The invention is made on the background of the need of the related arts.

Accordingly, it is an object of the invention to provide a spark plug which is capable of keeping superior airtightness and superior strength of holding the insulator for a long period.

According to one aspect of the present invention, there is provided a spark plug for an internal combustion engine, comprising: an insulator provided at its inside with a center electrode; a tubular housing disposed to surround an outer periphery of the insulator; an annular space portion provided between the housing and the outer periphery of the insulator; and a powder filling filled in the annular space portion so as to be formed as a filled portion therein, the powder filling being composed of a plurality of filling grains, 80 weight percent and over of the filling grains, before the powder filling is filled in the annular space, having a range from 100 to 1000 $\mu$m in grain diameter, respectively.

According to another aspect of the invention, there is provided a spark plug for an internal combustion engine, comprising: an insulator provided at its inside with a center electrode; a tubular housing disposed to surround an outer periphery of the insulator; an annular space portion provided between the housing and the outer periphery of the insulator; and a powder filling filled in the annular space portion so as to be formed as a filled portion therein, the powder filling containing an auxiliary filling added thereto.

BRIEF DESCRIPTION OF THE DRAWINGS

Other objects and aspects of the invention will become apparent from the following description of embodiments with reference to the accompanying drawings in which.

DETAILED DESCRIPTION OF EMBODIMENTS

Figure 1:
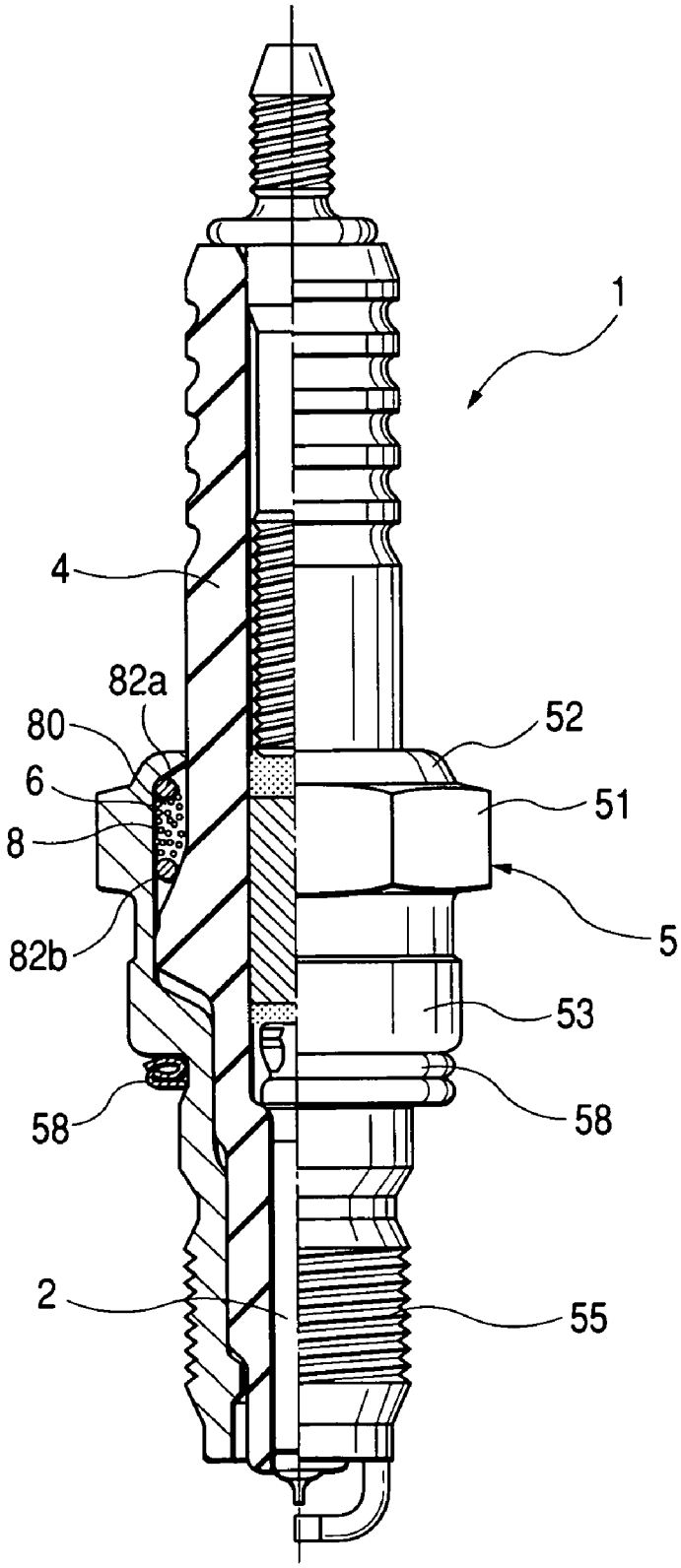
FIG. 1 is a semi-cross sectional view showing a spark plug according to a first embodiment of the invention.

According to the spark plug related to the one aspect of the invention, the filled portion between the insulator and the housing is composed of the powder filling composed of talc grains, 80 weight percent and over of which, before the powder filling is filled, have comparatively large grain diameters within the range from 100 to 1000 μm, respectively.

That is, the powder filling composed of the talc grains each having the large grain diameter does not appreciably have air component so that, when filling the powder filling into the annular space portion, only pressurization of the powder filling allows relative density of the powder filling to be easily increased. Therefore, it is possible to obtain the dense filled portion with high relative density and high airtightness.

In addition, the dense filled portion with high relative density can cause its strength to increase, making it possible to keep high strength of the filled portion with respect to external force, thereby improving the strength of holding the insulator by the filled portion.

Because a conventional powder filling is composed of fine particles, for example, 50 μm or less, and the fine particles are easily agglutinated as they are so that the flowability of the conventional powder filling is deteriorated, it is necessary to granulate the fine particles by adding the organic component to each of the fine particles.

In contrast, the powder filling is composed of the talc grains each having the large grain diameter so that it is unnecessary to use the granulated powder grains which are formed by granulating the particles which are fine, as used in the related arts, eliminating the need for the organic component such as binder component by which the particles can be adhered with each other.

Therefore, it is possible to prevent organic component such as binder from scattering at elevated temperatures, as compared with the conventional powder filling, so that, even when using the spark plug according to the one aspect of the invention for a long period, it is possible to keep the filled portion dense like its initial condition.

According to the spark plug related to the another aspect of the invention, the auxiliary is added to the powder filling constituting the filled portion so that the auxiliary is filled in the gap between each of the filling grains constituting the powder filling, thereby forming further high dense filled portion, making it possible to secure high airtightness in the filled portion.

Moreover, adding the auxiliary to the powder filling allows filling strength of each of the filling grains of the powder filling to be high at the pressurization. As a result, it is possible to keep high strength of the filled portion with respect to external force, as compared with conventional powder fillings, thereby improving the strength of holding the insulator by the filled portion.

As described above, according to the one and another aspects of the invention, it is possible to provide a spark plug comprising the filled portion having superior airtightness and keeping high its strength of holding the insulation.

Furthermore, in the one aspect of the invention, in a case where a ratio of filling grains having the range from 100 to 1000 μm in grain diameter to the total amount of filling grains is less than 80 weight percent, it is hard to make high the density of the filled portion so that it may be difficult to secure high airtightness in the filled portion. It is most preferable that all filling grains of the powder filling, before the powder filling is filled in the annular space portion, have a range from 100 to 1000 μm in grain diameter, respectively.

In a case where many filling grains contained in the powder filling is less than 100 μm in grain diameter, the formability of the powder filling is deteriorated so that the filled portion may have low airtightness In addition, in a case where many filling grains contained in the powder filling is more than 1000 μm in grain diameter, the flowability of each of the filling grains of the powder filling is deteriorated when filling the powder filling in the annular space portion. As a result, the filled portion has a plurality of gaps between each of the grains of the powder filling before pressurizing, causing, after pressurizing, the density of the powder filling not to be increased.

In the one aspect of the invention, as the powder filing, any material, such as talc, boron nitride or the like may be used.

In the one aspect of the invention, it is preferable that 80 weight percent and over of the filling grains, before the powder filling is filled in the annular space, have a range from 210 to 710 μm in grain diameter, respectively.

In addition, it is preferable that the powder filling contains organic component and an amount of the organic component contained in the powder filling is less than 0.2 weight percent.

In a case of using the spark plug having the powder filling including organic component, the organic component in the powder filling volatilizes with time, causing pore rate in the powder filling to be increased.

In contrast, in the preferable embodiment of the one and another aspects of the invention, using powder filling containing organic component of 0.2 weight percent (inside weight percent) or less allows pores in the filled portion to be decreased after the organic component volatilizes.

Therefore, it is possible to prevent airtightness in the filled portion from being deteriorated with time, and mechanical strength of the filled portion from being weaken with time.

When the granulated powder grains are used as the powder filling, an amount of the organic component is increased. Usually, substantially 0.3 to 0.8 weight percent of organic component is contained in the granulated powder grains. The powder filling containing the amount of organic component which is less than the 0.2 weight percent can be considered as a powder filling composed of primary non-granulated grains.

Assuming that the filled portion is formed on the basis of the powder filling containing the amount of organic component which is not less than 0.2 weight percent, the organic component in the powder filling volatilizes with time, allowing pores to be easily formed in the powder filling, causing the airtightness in the filled portion to be deteriorated with time, and mechanical strength of the filled portion to be weaken with time.

It is most preferable that the powder filling has no organic component.

It is preferable that the powder filling is composed of filling grains each of which has a pore rate which is not more than 2%.

Filling the dense filling grains each of that has the pore rate which is not more than 2% in the annular portion to pressurize it, allows the dense filled portion having high density to be easily obtained. Each grain having a pore rate which is not less than 2% contains inside many pores so that, even when pressurizing the powder filling, it is hard to improve the relative density of the filled portion so that it is difficult to obtain the dense filled portion with high airtightness.

Incidentally, the smaller the pore rate of the powder filling is, the more preferable the powder filling is.

It is preferable that the powder filling has a pore rate which is not more than 6%.

Setting 80 weight percent of then filling grains within the range from 10 to 100 $\mu$m allows the pressurized powder filling to be dense.

In particular, setting the pore rate in the filled portion to 6% or less makes superior airtightness in the filled portion and the strength thereof. Even if pressurization conditions vary or the pressurization conditions fluctuate, because the pore rate is set to 6% or less, it is possible to obtain the filled portion with high density and large mechanical strength thereof.

When the conventional powder filling comprising particles each of which comparatively has a short grain diameter, such as the granulated powder grains is used, even if the pressurizing force is increased, it is difficult to obtain the filled portion having the pore rate of 6% or less.

In contrast, in the one and another aspects of the invention, using the powder filling composed of the filling grains each of which is not granulated and has a comparatively large diameter, allows the filled portion with the density to be easily manufactured without specially controlling the pressurizing conditions It is preferable that the powder filling has a pore rate which is not more than 2%, making it possible to obtain the filled portion with further superior airtightness and further superior strength.

It is preferable that the powder filling is pressurized to be formed as a bulk body corresponding to the annular space portion, and the bulk body is filled in the annular spade portion.

After forming the powder filling into the bulk body, it is possible to easily fill the bulk body into the annular space portion of the spark plug. Even though the forming process of the bulk body is increased, because of saving a lot of labor, it is possible to increase a productivity of the spark plug. In addition, when the bulk body has certain degree of high strength, it is possible to automatically fill the bulk body into the annular space portion.

Still furthermore, the insulator is composed of, for example, burned ceramic, and has surface relative roughness which is poor. For example, surface relative roughness Rz equals to 20 $\mu$m. The poor surface relative roughness may cause the flowability of each of the grains to be inhibited, interrupting the forming of dense filled portion.

Then, in the preferable embodiment, when the powder filling is formed into the bulk body and the bulk body is filled into the annular space portion, it is possible to smoothly fill the bulk body into the annular space portion in spite of the powder flowability of the outer peripheral surface of the insulator. In addition, the powder filling is formed by using a mold so that it is easy to secure a constant filling amount, a constant filling density and a predetermined size of the bulk body, respectively.

In a preferred embodiment of the another aspect, the auxiliary filling is composed of material containing crystal water or absorbed water.

According to the preferred embodiment, moisture contained in the crystal water or absorbed water gets into the gap between each of the filling grains of the powder filling, allowing each of the filling grains to move. Pressurizing the powder filling permits the filling grains to be dense.

Because the crystal water or the absorbed water consists of moisture, the strength of the powder filling itself is made high, causing the strength of holding the insulator to be increased.

It is also preferable that the auxiliary filling is composed of at least one of first aluminum phosphate ($Al_2O_3.3P_2O_5.6H_2O$), sodium silicate solution and potassium silicate solution.

According to this preferred embodiment, moisture contained in the crystal water or absorbed water gets into the gap between each of the filling grains of the powder filling, allowing each of the filling grains to move. Pressurizing the powder filling permits the filling grains to be dense.

Because the crystal water or the absorbed water consists of moisture, the strength of the powder filling itself is made high, causing the strength of holding the insulator to be increased.

In a preferred embodiment of this another aspect, an amount of the auxiliary filling contained in the powder filling is a range from 0.1 to 5 w/t parts, making it possible to obtain dense filled portion having high density and low pore rate.

In a case where the amount of the auxiliary filling contained in the powder filling is less than the 0.1 w/t parts, this amount of the auxiliary filling is insufficient to fully fill in the gaps between the filling grains of the powder filling so that the filled portion with high density may not be obtained.

On the other hand, in a case where the amount of the auxiliary filling contained in the powder filling is more than the 5 w/t parts, this amount of the auxiliary filling exceeds a suitable amount of moisture so that much moisture contained in the powder filling volatilizes at elevated temperatures, causing the airtightness in the filled portion to be deteriorated. The volatilization of the moisture causes the pore rate in the powder filling to be increased so that the strength of the powder filling itself may be decreased.

In a preferred embodiment of this another aspect, the filled portion composed of the powder filling to which the auxiliary filling is added has a pore rate and the pore rate is not more than 6%. This structure allows the density and the strength of the filled portion to be increased.

It is preferable that the filled portion composed of the powder filling to which the auxiliary filling is added has a pore rate and the pore rate is not more than 2%, making it clear that the density and the strength of the filled portion are increased.

Further embodiments of the invention will be described hereinafter with reference to the accompanying drawings.

(First Embodiment)

Figure 2:
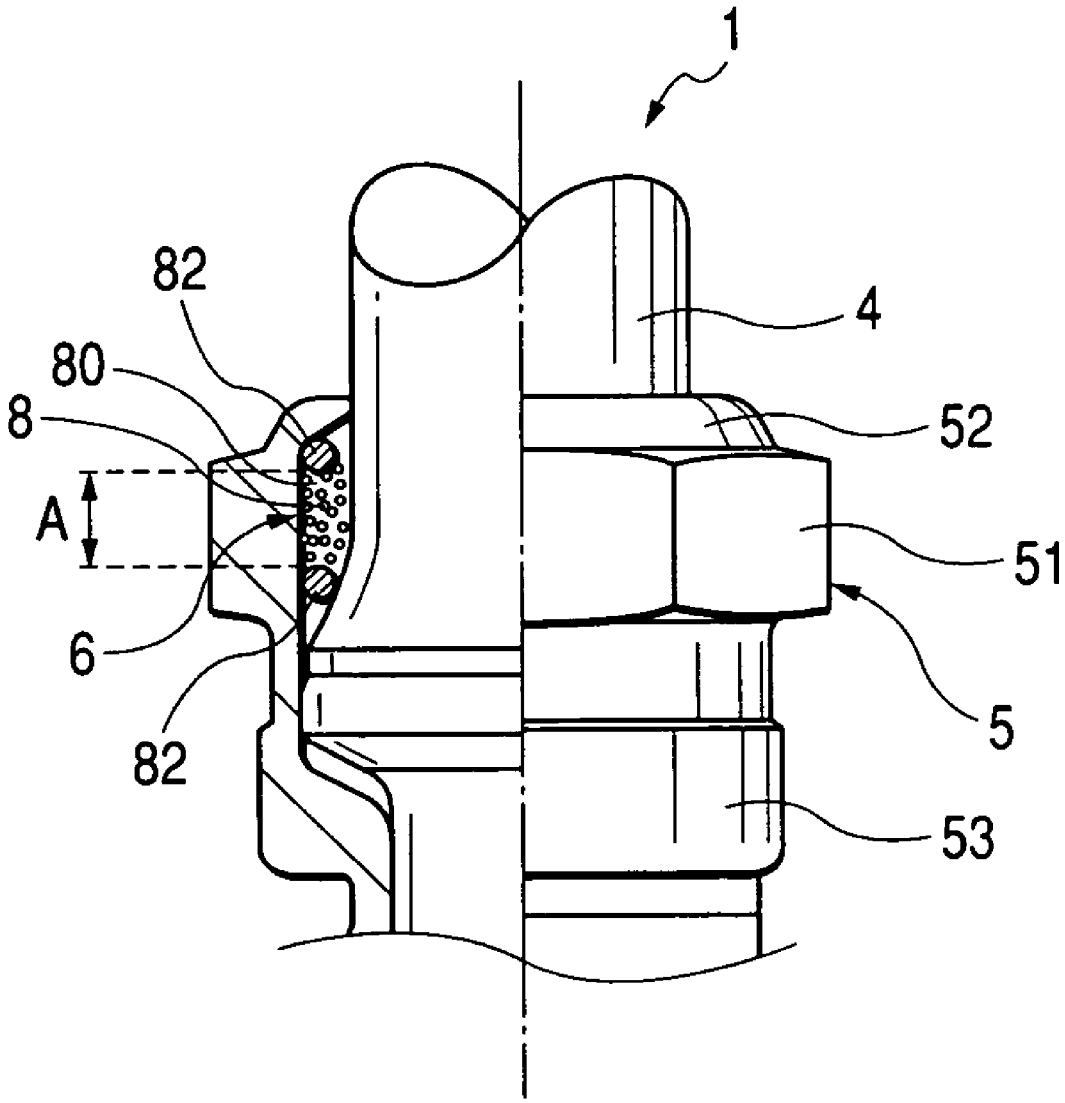
FIG. 2 is a semi-cross sectional and enlarged view showing a substantial part of the spark plug according to the first embodiment of the invention.
Figure 3:
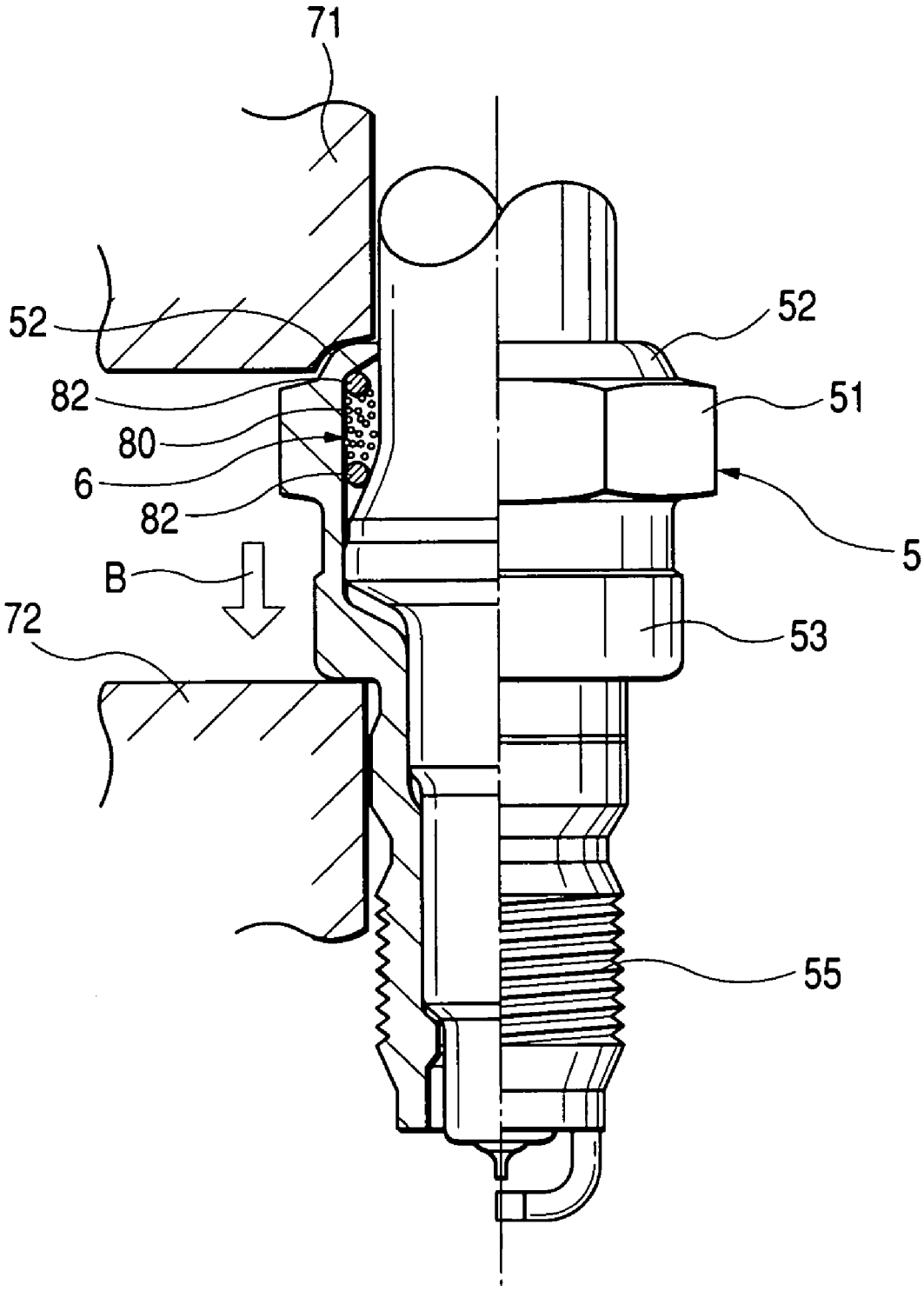
FIG. 3 is a semi-cross sectional and enlarged view showing a substantial part of the spark plug according to the first embodiment of the invention.

A spark plug according to a first embodiment is shown in FIG. 1 to FIG. 3. As shown in FIG. 1 to FIG. 3, the spark plug 1 according to the first embodiment comprises an insulator 4 provided at its inside with a center electrode 2 so that the insulator 4 surrounds the outer periphery of the center electrode 2 and supports it.

In addition, the spark plug 1 is provided with a tubular housing 5 disposed to surround the outer periphery of the substantially lower half portion of the insulator 4 and an annular space portion 6 between the housing 5 and the outer periphery of the insulator 4.

Incidentally, in this first embodiment, a discharge gap side of the spark plug 1 is referred to as its lower side, and other end side of the spark plug opposite to the discharge gap side thereof is referred to as its upper side.

Furthermore, the spark plug 1 is provided with a powder filling 80 filled in the annular space portion 6 so as to form a filled portion 8 for improving the airtightness of the spark plug 1.

The housing 5 is formed with a tubular polygonal fitting portion 51, such as a hexagonal fitting portion with bolt width, surrounding to the annular space portion 6 to provide the annular space portion 6. The fitting portion 51 allows the spark plug 1 to be rotated when fitting the spark plug 1. The housing 5 is also formed at its upper end with a sleeve 52 which is caulked inwardly toward a center axis of the spark plug 1 so as to hermetically close the filled portion 8.

In this first embodiment, the spark plug 1 is provided with a pair of ring members 82 made of carbon steel, one of which (upper ring member 82*a*) is disposed in an upper end of the annular space portion 8 shown in FIG. 1 and other of which (lower ring member 82*b*) is disposed in a lower end thereof.

The powder filling 80 is filled within a range from the upper ring member 82*a* to the lower ring member 82*b* in the annular space portion 6 so that the filled powder filling 80 forms the filled portion 8 between the upper ring member 82*a* and the lower ring member 82*b*. For example, the axial length of the filled portion 8 is approximately 4 mm.

When manufacturing the spark plug 1, the insulator 4 and the tubular housing 5 are assembled so that the housing 5 is fitted to the insulator 4, forming the annular space portion 6 between the housing 5 and the outer periphery of the insulator 4.

After the assemble of the insulator 4 and the housing 5, the upper ring member 82*a* and the lower ring member 82*b* are inserted to be disposed in the upper end and lower end of the annular space portion 6, respectively, allowing the airtightness of a space therebetween in the annular space portion 6 to be improved. The powder filling 80 is fully filled between the upper ring member 82*a* and the lower ring member 82*b* in the annular space portion 6.

When filling the powder filling 80 in the annular space portion 6, pre-pressurizing the powder filling 80 allows filling efficiency of the powder filling 80 to be improved. In addition, the powder filling 80 is pressurized to be formed as a bulk body having an annular shape corresponding to the annular space portion 6, and the bulk body is filled between the upper ring member 82*a* and the lower ring member 82*b* to form the filled portion 8 therebetween, referred to as a seventh embodiment of the invention hereinafter.

In this first embodiment, the powder filling 80 is made of talc powder that is composed of a plurality of talc grains. 80 weight percent (wt %) and over of the talc grains of the powder filling 80 before it is filled have a range from 100 to 1000 $\mu$m in grain diameter, respectively.

Next, as shown in FIG. 3, a pair of first and second caulking jigs 71 and 72 is prepared. The sleeve 52 of the housing 5 and a lower surface of a projecting portion 53 thereof which is positioned to a lower side of the sleeve 52 and projects radially are tightly held to approach with each other in the axial direction by the caulking jigs 71 and 72, caulking the sleeve 52 inwardly toward the center axis of the spark plug 1.

The caulked sleeve 52 pressurizes the upper and lower ring members 82*a* and 82*b*, and the powder filling 80 to form the filled portion 8.

Incidentally, as shown in FIG. 1, the housing 5 is formed at its lower periphery with an M10 fitting screw portion 55 screwed to be fitted in an engaging hole of internal combustion engines. The spark plug 1 is provided at the upper side of the fitting screw portion 55 with a tubular gasket 58 disposed to fit to the outer periphery of the housing 5.

Next, operations and effects of the spark plug 1 according to the first embodiment will be described hereinafter.

The spark plug 1 according to the first embodiment is formed with the filled portion 8 between the insulator 4 and the housing 5, filled portion 8 which is composed of the powder filling 80 composed of talc grains, 80 weight percent (wt %) and over of which, before the powder filling 80 is filled, have comparatively large grain diameters within the range from 100 to 1000 $\mu$m, respectively.

The powder filling 80 composed of the talc grains each having the large grain diameter does not appreciably have air component so that, when filling the powder filling 80 into the annular space portion 6, only pressurization of the powder filling 80 allows relative density of the powder filling 80 to be easily increased. Therefore, pressurizing the powder filling 80 by the jigs 71 and 72 allows the dense filled portion 8 with high relative density and high airtightness to be obtained.

The dense filled portion 8 with high relative density can cause its strength to increase, making it possible to keep high strength of the filled portion 8 with respect to external force, thereby improving the strength of holding the insulator 4 by the filled portion 8.

The powder filling 80 is composed of the talc grains each having the large grain diameter so that it is unnecessary to use the granulated powder grains which are formed by granulating the raw powder particles which are fine, as used in the related arts, eliminating the need for the binder component by which the particles can be adhered with each other.

Therefore, it is possible to prevent binder from scattering at elevated temperatures, as compared with the conventional powder filling, so that, even when using the spark plug 1 according to the first embodiment for a long period, it is possible to keep the filled portion 8 dense like its initial condition.

As described above, according to the first embodiment, it is possible to provide the spark plug 1 comprising the filled portion 8 capable of keeping superior airtightness and superior strength of holding the insulator 4.

(Second Embodiment)

Spark plugs according to a second embodiment of the invention have different powder fillings 80*a*1 to 80*a*5 corresponding to example 1 to example 5. The powder fillings 80*a*1 to 80*a*5 have different distributions in grain diameter, respectively, which are shown in a graph of FIG. 4.

Figure 5:
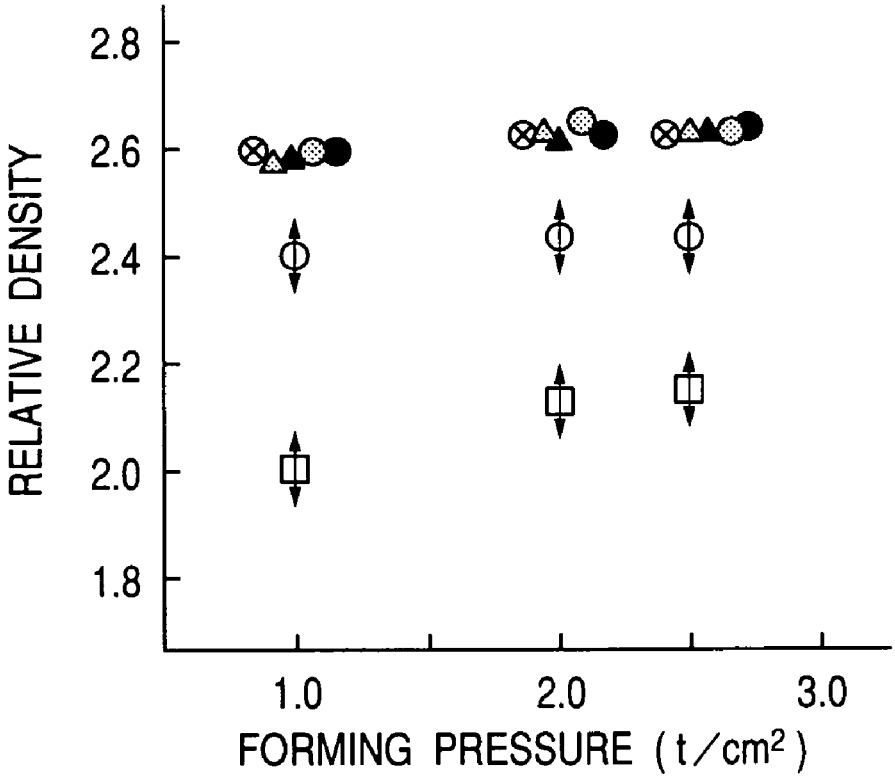
FIG. 5 is a graph showing relative densities of obtained forming products with respect to forming pressures of the examples 1 to 5, the comparative examples 1 and 2 according to the second embodiment of the invention.
Figure 6:
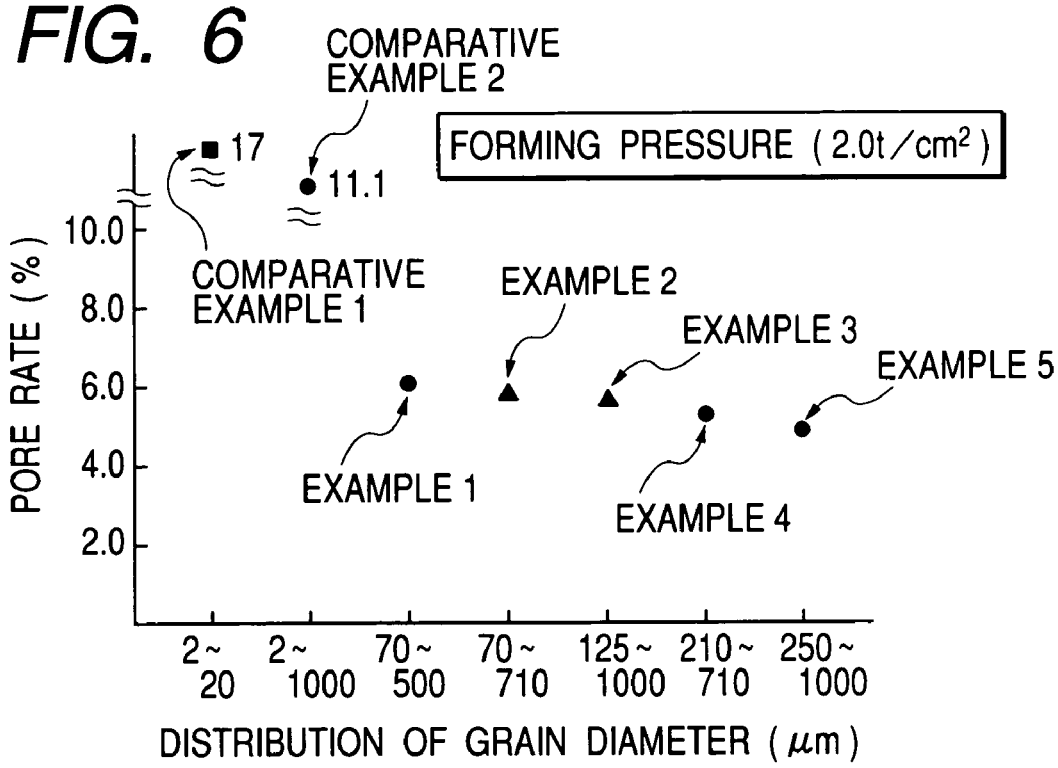
FIG. 6 is a graph showing pore rate of each of the forming products of each of the powder fillings of the examples 1 to 5, the comparative examples 1 and 2 at the forming pressure of 2.0 (t/cm$^2$) according to the second embodiment of the invention.
Figure 7:
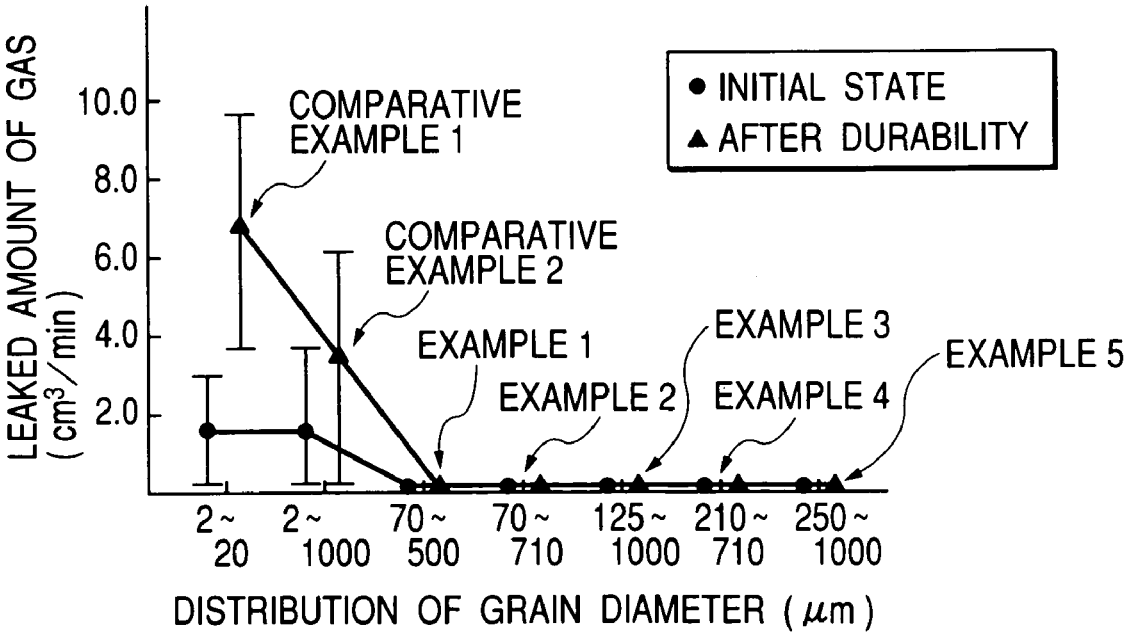
FIG. 7 is a graph showing a relationship between a leaked amount of gas and each of the spark plugs of the examples 1 to 5, the comparative examples 1 and 2 according to the second embodiment of the invention.

FIGS. 5 to 7 show various characteristics of the powder fillings 80*a*1 to 80*a*5 corresponding to the examples 1 to 5 according to the second embodiment, respectively.

The powder filling 80*a*1 is made of talc powder that is composed of a plurality of talc grains, and 80 wt % and over of the talc grains have a range from 70 to 500 μm in grain diameter. The powder filling 80*a*2 is made of talc powder that is composed of a plurality of talc grains, and 80 wt % and over of the talc grains have a range from 70 to 710 μm in grain diameter. The powder filling 80*a*3 is made of talc powder that is composed of a plurality of talc grains, and 80 wt % and over of the talc grains have a range from 125 to 1000 μm in grain diameter. The powder filling 80*a*4 is made of talc powder that is composed of a plurality of talc grains, and 80 wt % and over of the talc grains have a range from 210 to 710 μm in grain diameter. The powder filling 80*a*5 is made of talc powder that is composed of a plurality of talc grains, and 80 wt % and over of the talc grains have a range from 250 to 1000 μm in grain diameter.

In addition, as comparative examples with respect to the examples 1 to 5 according to the second embodiment, a powder filling PF1 of comparative example 1 is prepared, that is composed of a plurality of talc grains each of which has a range from 2 to 20 μm in grain diameter. Moreover, a powder filling PF2 of comparative example 2 is prepared, that is composed of a plurality of talc grains each of which has a range from 2 to 1000 μm in grain diameter.

Figure 4:
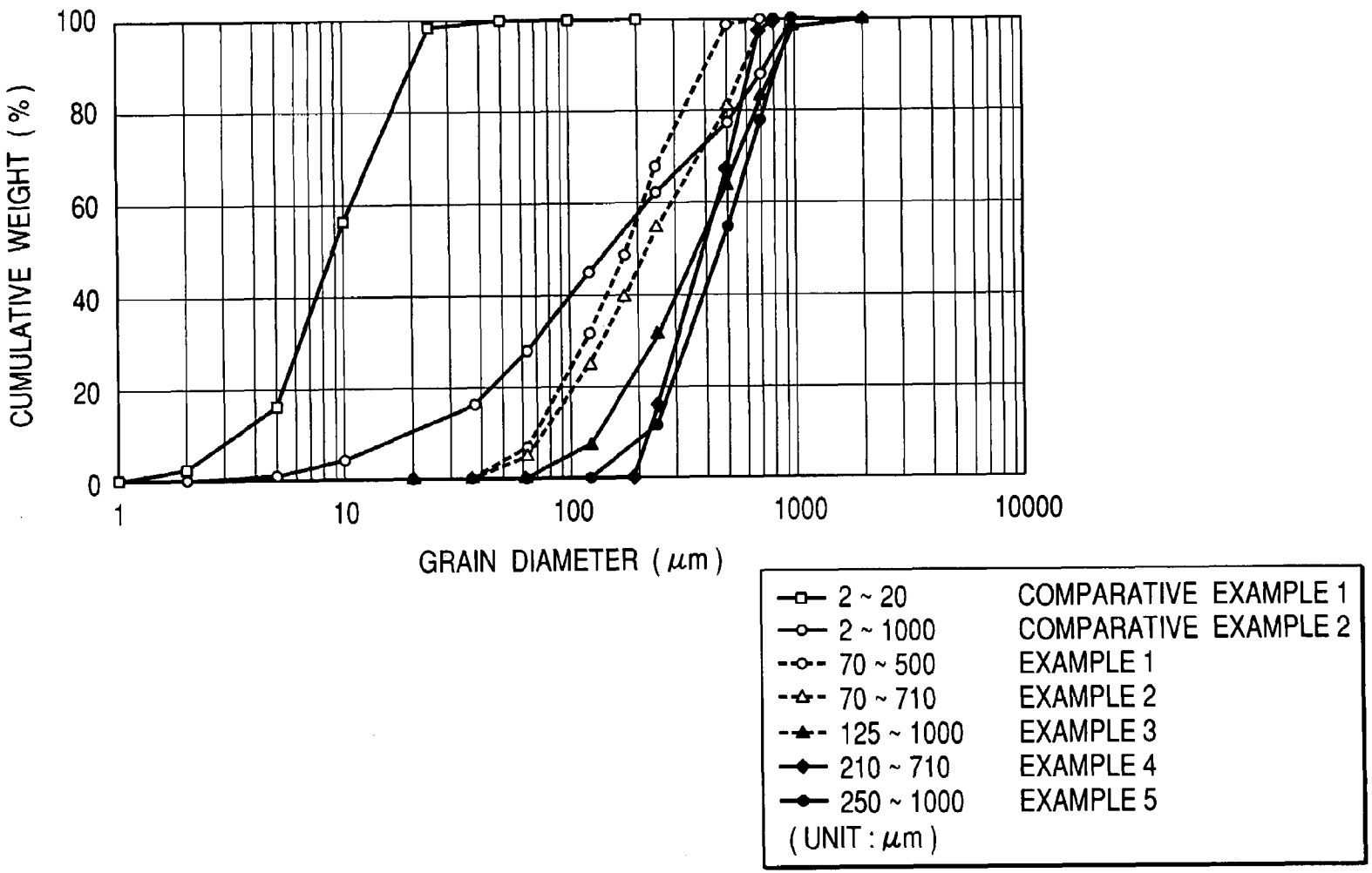
FIG. 4 is a graph showing a relationship between cumulative weights and grain diameters of powder fillings of examples 1 to 5, comparative examples 1 and 2 according to a second embodiment of the invention.

As clearly shown in FIG. 4, a ratio of grains having the range from 100 to 1000 μm in grain diameter to the total amount of grains in the powder filling PF1 is greatly smaller than that of talc grains having the range from 100 to 1000 μm in grain diameter to the total amount of the talc grains of each of the powder fillings 80*a*1 to 80*a*5. Similarly, a ratio of grains having the range from 100 to 1000 μm in grain diameter to the total amount of grains in the powder filling PF2 is greatly smaller than that of talc grains having the range from 100 to 1000 μm in grain diameter to the total amount of the talc grains of each of the powder fillings 80*a*1 to 80*a*5.

In the graph of FIG. 4, the vertical axis represents cumulative weight percent, and the horizontal axis represents grain diameter.

Each of the powder fillings 80*a*1 to 80*a*5, PF1 and PF2 having each of the distributions in grain diameter shown in FIG. 4 is pressurized at predetermined forming pressures ranging from, for example, 1.5 (t/cm$^2$) which equals to 15×9.80655 MPa to 3.0 (t/cm$^2$) which equals to 30×9.80655 MPa to be formed into a number of formed products. In this second embodiment, the number of formed products on the basis of the powder fillings 80*a*1 to 80*a*5 is 5 (n=5).

FIG. 5 is a graph showing relative densities of the obtained forming products with respect to the forming pressures.

As clearly shown in FIG. 5, because each of the powder fillings 80*a*1 to 80*a*5 is made of the talc powder that is composed of the talc grains, and 80 wt % and over of the talc grains have the range from 100 to 1000 μm in grain diameter, the relative densities of the obtained forming products of the powder fillings 80*a*1 to 80*a*5 are larger than those of the powder fillings PF1 and PF2 at the same forming pressures.

In addition, as clearly shown in FIG. 5, the relative densities of the powder fillings 80*a*1 to 80*a*5 are substantially constant even though the forming pressures are changed.

Furthermore, FIG. 6 is a graph showing pore rate (%) of each of the forming products of each of the powder fillings 80*a*1 to 80*a*5, PF1 and PF2 at the forming pressure of 2.0 (t/cm) which equals to 20×9.80655 MPa.

As clearly shown in FIG. 6, each of the pore rates of each of the obtained forming products of each of the powder fillings 80*a*1 to 80*a*5 is larger than each of the powder fillings PF1 and PF2.

That is, as described above, using the powder fillings 80*a*1 to 80*a*5 according to the second embodiment of the invention allows the airtightness and the strength of the spark plug to be improved, as compared with using the powder fillings PF1 and PF2 according to the comparative examples 1 and 2.

Then, when each of the powder fillings 80*a*1 to 80*a*5, PF1 and PF2 is used for each of the spark plugs 1*a*1 to 1*a*5, 100PF1 and 100PF2 having the same structure of the spark plug according to the first embodiment, each performance of each of the spark plugs 1*a*1 to 1*a*5, 100PF1 and 100PF2 was estimated.

Concretely, each of the spark plugs 1*a*1 to 1*a*5, 100PF1 and 100PF2 was set to a special airtightness measurement system, gas (air) of 2 MPa was supplied to an inner side of the fitting screw portion 55 of the housing 5 of each of the spark plugs 1*a*1 to 1*a*5, 100PF1 and 100PF2 so that amount of the gas passing through the sleeve 52, such as the leaked amount of the gas, was measured.

As other conditions, when setting each of the spark plugs 1*a*1 to 1*a*5, 100PF1 and 100PF2, fastening torque was set to 25 Nm, and temperature of the gasket 58 was set to 300° C.

FIG. 7 is a graph showing a relationship between the leaked amount of the gas, referred to "initial state", and each of the spark plugs 1*a*1 to 1*a*5, 100PF1 and 100PF2, wherein the horizontal axis represents distribution of grain diameters of the powder fillings 80*a*1 to 80*a*5, and the vertical axis represents the leaked amounts of the gas in the spark plugs 1*a*1 to 1*a*5, 100PF1 and 100PF2, the unit of which is cc (cm$^3$)/minute (min).

As clearly shown in FIG. 7, as grain diameter is increased, airtightness is increased, similarly to the pore rate of each of the obtained forming products corresponding to each of the spark plugs 1*a*1 to 1*a*5.

As durability test of each of the spark plugs 1*a*1 to 1*a*5, 100PF1 and 100PF2, each of the spark plugs 1*a*1 to 1*a*5, 100PF1 and 100PF2 was left in an oven at temperature of 300° C. for 24 hours, and after that, amount of the gas passing through the sleeve 52, such as the leaked amount of the gas of each of the spark plugs 1*a*1 to 1*a*5, 100PF1 and 100PF2, was measured in the same manner.

In the graph of FIG. 7, a relationship between the leaked amount of the gas and each of the spark plugs 1*a*1 to 1*a*5, 100PF1 and 100PF2, which is already durability tested referred to as "after durability" is shown.

As clearly shown in FIG. 7, after each of the spark plugs 100PF1 and 100PF2 having each of the powder fillings PF1 and PF2 corresponding to the comparative examples 1 and 2 is durability tested, the leaked amount of each of the spark plugs 100PF1 and 100PF2 is greatly increased.

In contrast, before and after each of the spark plugs 1*a*1 to 1*a*5 having each of the powder fillings 80*a*1 to 80*a*5 corresponding to the examples 1 to 5 is durability tested, the leaked amount of each of the spark plugs 1*a*1 to 1*a*5 is substantially constant.

This result is considered as follows. That is, because each of the powder fillings PF1 and PF2 corresponding to the comparative examples 1 and 2 is composed of fine particles, organic component such as binder is added to each of the fine particles of each of the powder fillings PF1 and PF2 to be granulated so that each grain of each of the powder fillings PF1 and PF2 is substantially 100 μm in grain diameter. The adding process of the organic component such as binder causes the added binder to scatter while each of the spark plug is durability tested, that is, is left in the oven at the high temperatures so that the pore rate of each of the powder fillings PF1 and PF2 is decreased, causing airtightness of each filled portion of each of the spark plugs 100PF1 and 100PF2 to be deteriorated.

However, each of the powder fillings 80*a*1 to 80*a*5 of each of the spark plugs 1*a*1 to 1*a*5 has no organic component such as binder or the like, making it possible to keep constant the leaked amount before and after the durability test.

Third Embodiment)

In this third embodiment, a modification of the powder filling 80*a*4 corresponding to the example 4 of the second embodiment is explained. That is, 80 wt % and over of its talc grains have the range from 210 to 710 μm in grain diameter.

In this third embodiment, the modification of the powder filling 80*a*4 contains first aluminum phosphate ($Al_2O_3.3P_2O_5.6H_2O$) as an auxiliary filling added thereto.

Various characteristics of the modification of the powder filling 80*a*4 are measured.

A plurality of examples of the modification of the powder filling 80*a*4 to which different amounts of auxiliary fillings are prepared so that the powder fillings of the examples are pressurized at each of the forming pressures of 2.0 ($t/cm^2$) and 1.5 ($t/cm^2$), thereby forming five formed products.

Figure 8:
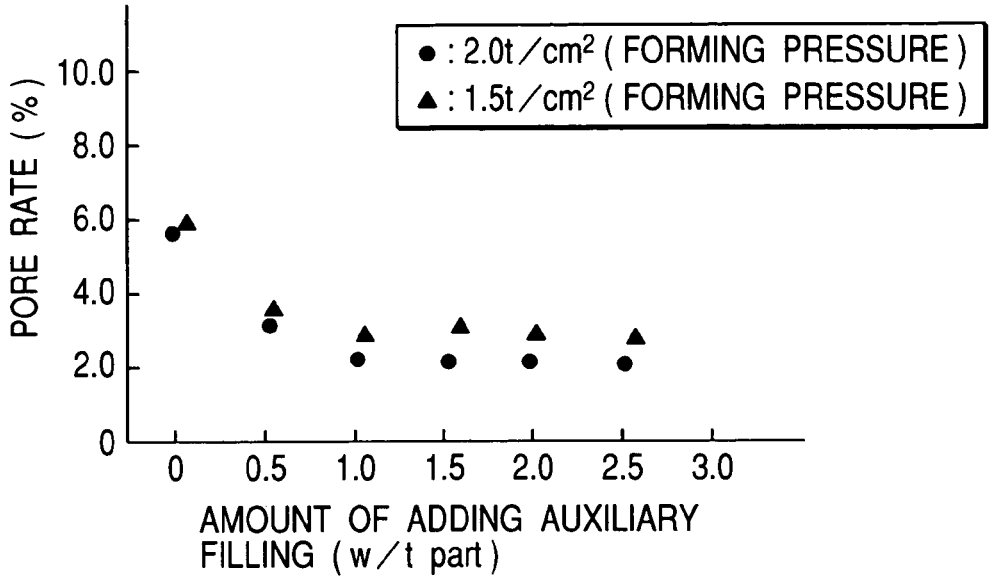
FIG. 8 is a graph showing pore rate of each of the forming products corresponding to examples of a modification of the example 4 according to a third embodiment of the invention.

FIG. 8 is a graph showing pore rate of each of the forming products corresponding to each of the examples of the modification, wherein the horizontal axis represents add amounts (unit: part by weight, w/t part) of auxiliary filling, and the vertical axis represents pore rates (unit: %).

As clearly shown in FIG. 8, adding the auxiliary filling to the powder filling 80*a*4 allows the pore rate to be decreased and the formed products to be dense.

That is, adding the auxiliary filling of 0.10 w/t parts and over to the powder filling 80*a*4 allows the pore rate to be decreased as compared with no auxiliary filling is added thereto, making it possible to confirm the effect of adding the auxiliary filling.

Figure 9:
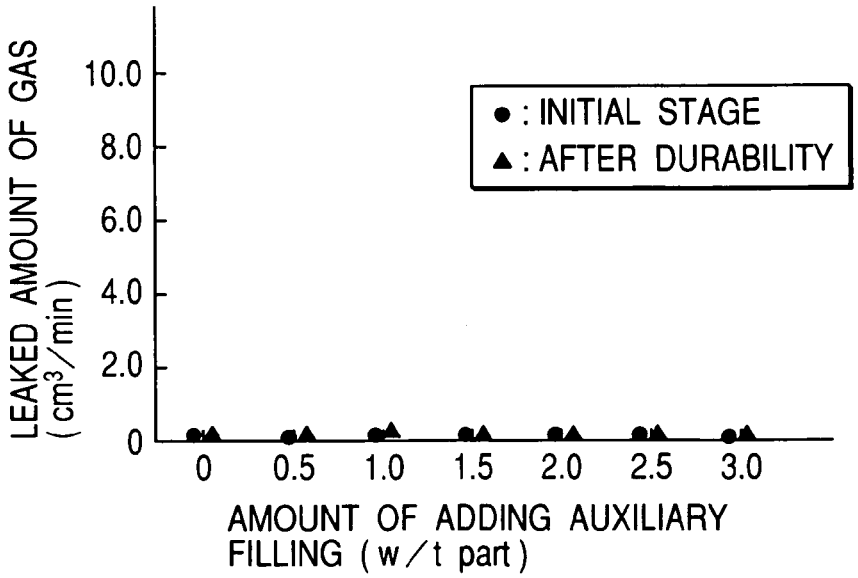
FIG. 9 is a graph showing a result of a durability test of a spark plug of the modification according to a third embodiment of the invention.

The spark plug 1*a*4 having the modification of the powder filling 80*a*4 to which the auxiliary filling is added was durability tested in the same manner of the second embodiment, and the result of the test is shown in a graph of FIG. 9.

As shown in the graph of FIG. 9, because of adding the auxiliary filling to the powder filling 80*a*4, before and after the spark plug 1*a*4 having the modification of powder filling 80*a*4 to which the auxiliary filling is added is durability tested, the leaked amount of the spark plug 1*a*4 is substantially constant.

This result is that the auxiliary filling does not scatter at elevated temperatures, which is different from the binder. Incidentally, the auxiliary filling has a little moisture, and it is known that the moisture evaporates under elevated temperatures. However, the added auxiliary filling is only 3 w/t parts or less so that the added auxiliary filling hardly affects on the leaked amount of the gas.

(Fourth Embodiment)

In this fourth embodiment, effects of holding the insulator of each of the spark plugs 1*a*4, 1*a*10, 1*a*11 and 1*a*12 are checked by performing the measurements, as compared with the spark plug 100PF1 having the powder filling PF1 of the comparative example 1 as follows.

The spark plugs 1*a*4 corresponding to the example 4 has the powder fitting 80*a*4. The spark plug 1*a*10 corresponding to modification 1 has the powder fitting 80*a*4 to which 1.0 w/t parts of the auxiliary fitting (first aluminum phosphate) is added. The spark plug 1*a*11 corresponding to modification 2 has the powder fitting 80*a*4 to which 2.0 w/t parts of the auxiliary fitting (first aluminum phosphate) is added. The spark plug 1*a*12 corresponding to modification 3 has the powder fitting 80*a*4 to which 3.0 w/t parts of the auxiliary fitting (first aluminum phosphate) is added.

Figure 10:
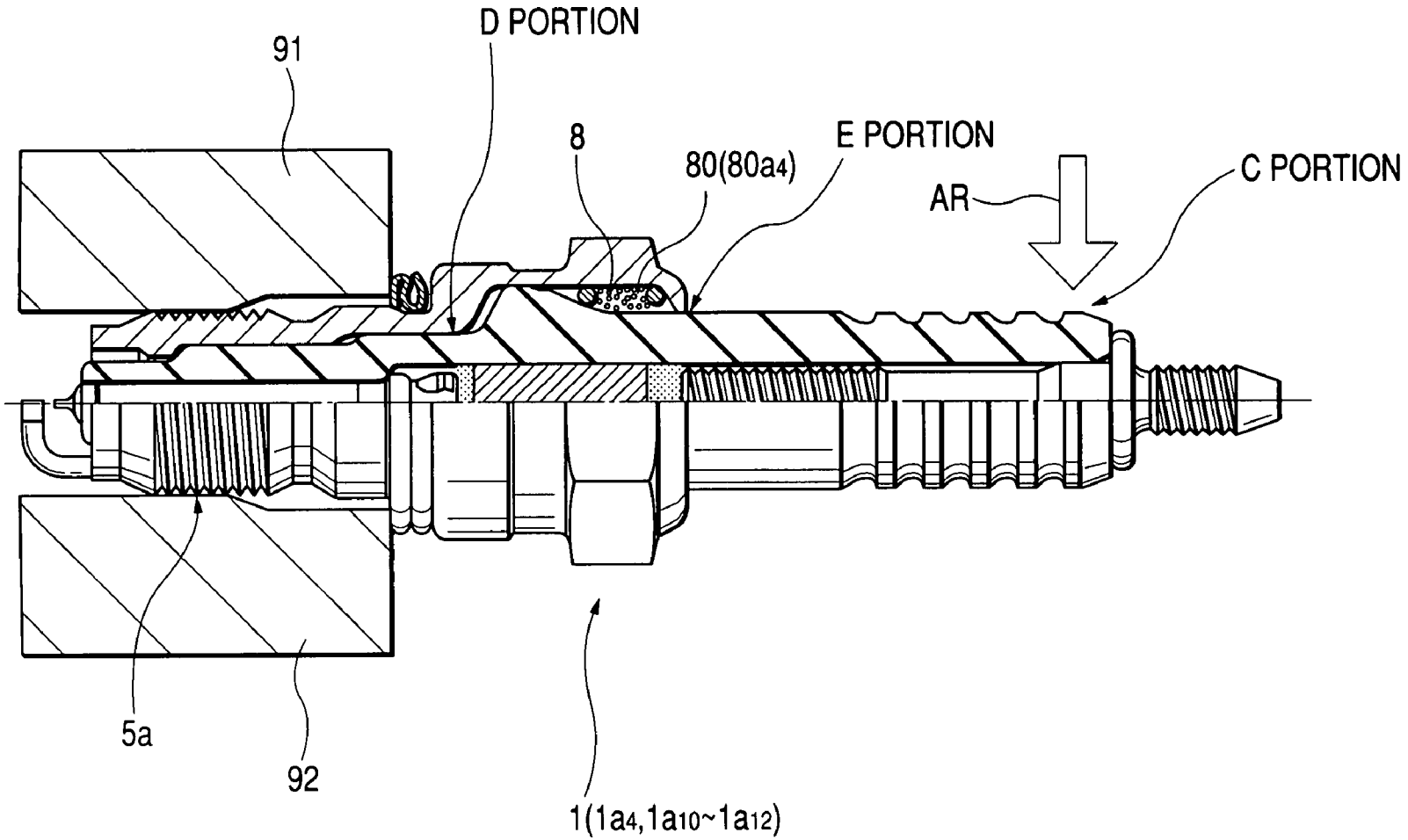
FIG. 10 is a semi-cross sectional view showing a spark plug to which load is applied according to a fourth embodiment of the invention.

That is, as shown in FIG. 10, the outer periphery 5*a* of the housing 5 surrounding the fitting screw portion 55 of each of the spark plugs 1*a*1, 1*a*10 to 1*a*12 and 100PF1 was picked up with fixing jigs 91 and 92, and each of the spark plugs 1*a*1, 1*a*10 to 1*a*12 and 100PF1 was fixed by tightening a screw disposed to the fixing jigs 91 and 92 at tightening force of 25 N·m so as to clamp the fitting screw portion 55 thereby.

While each of the spark plugs 1*a*1, 1*a*10 to 1*a*12 and 100PF1 was fixed, an upper end portion (C portion) of the insulator 4 of each of the spark plugs 1*a*1, 1*a*10 to 1*a*12 and 100PF1 was supplied to load from a load measurement device in a radial direction shown by an arrow AR so that strength at which the insulator 5 was cracked was estimated as cracking load. Incidentally, speed of applying load to the C portion of each of the spark plugs 1*a*1, 1*a*10 to 1*a*12 and 100PF1 was 2.5 mm/min (minute).

Each of the spark plugs 1*a*1, 1*a*10 to 1*a*12 and 100PF1 used for the measurement is shown in FIG. 1.

Figure 11:
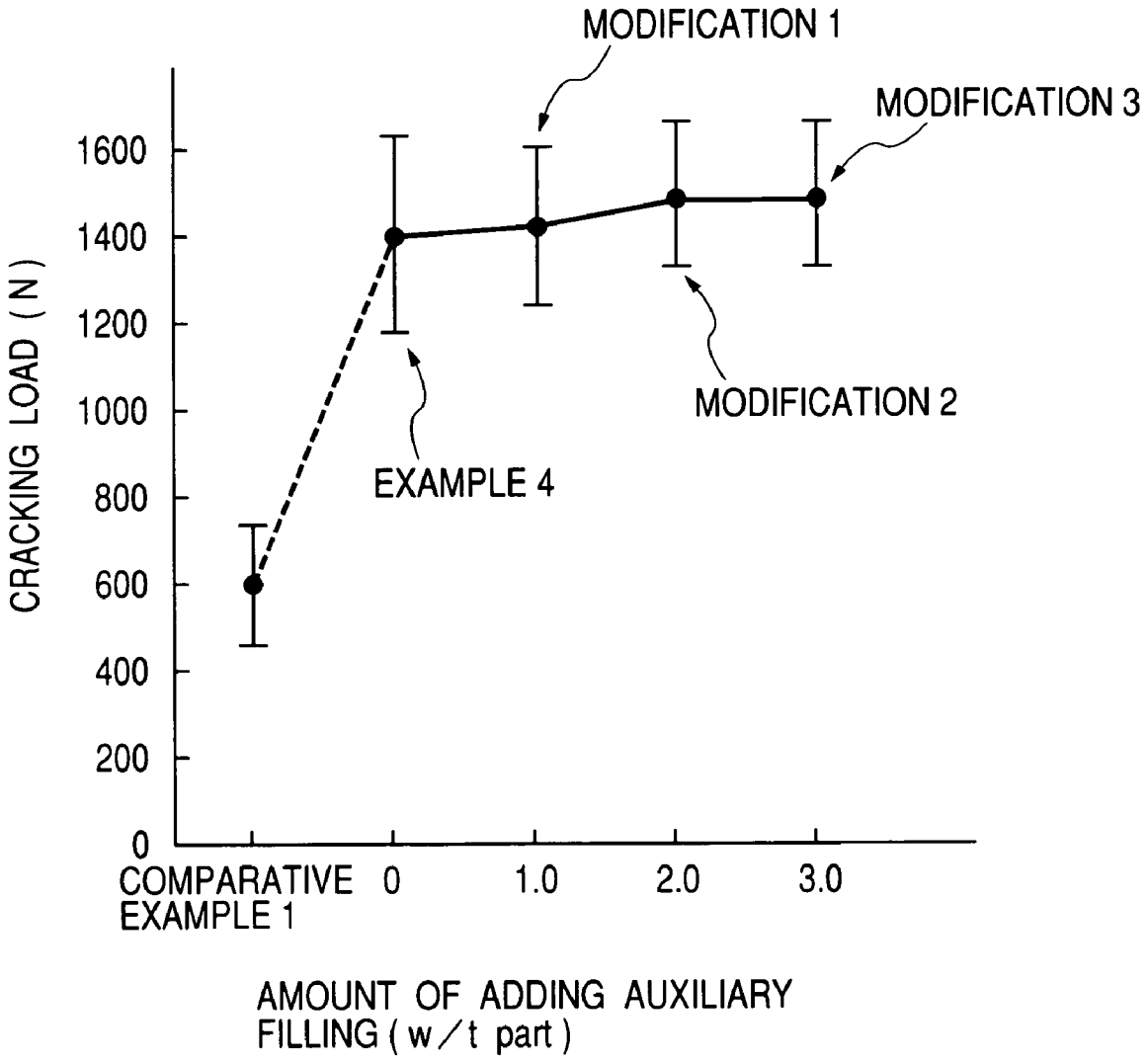
FIG. 11 is a graph showing a result of a measurement of cracking load at which an insulator of the spark plug is cracked according to the fourth embodiment of the invention.

The result of the measurement is shown in a graph of FIG. 11.

The spark plug 100PF1 corresponding to the comparative example 1 has low density of the powder filling PF1 and large pore rate as compared with each of the spark plugs 1*a*4, 1*a*10 to 1*a*12 so that, when load is applied to the upper portion of the insulator 4, it is hard to sufficiently hold the insulator 4. As a result, when the C portion of the spark plug 100PF1 is supplied to large bending moments, the insulator 4 gets to be cracked from its D portion as the starting point of cracking so that the cracking load is low as 600 N.

In contrast, the spark plug 1*a*4 having the powder filling 80*a*4 according to the invention corresponding to the example 4 has high density of the powder filling 80*a*4 as compared with the spark plug 100PF1, so that, when load is applied to the upper portion of the insulator 4, it is possible to hold the insulator 4 at its E portion corresponding to the filled portion 80 thereof. As a result, because the spark plug 1*a*4 will get to be cracked from the E portion as the starting point of cracking, bending moments are decreased so that the spark plug 1*a*4 does not get to be cracked up to 1400 N of the cracking load being applied to the C portion.

Furthermore, the above same effects are obtained in case of each of the spark plugs 1*a*10 to 1*a*12 to which the auxiliary filling is added, and the cracking load is constant irrespective of the increase of the amount of auxiliary filling.

However, when the amount of auxiliary filling which is more than the 5 w/t parts is added to powder fillings according to the invention, it is known that filling products formed on the basis of the powder fillings to which the amount of auxiliary filling which is more than the 5 w/t parts is added are too hard to be fragile. Therefore, it is preferable that the amount of adding auxiliary filling to the powder fillings according to the invention is not more than the 5 w/t parts.

(Fifth Embodiment)

In this fifth embodiment, a spark plug of the fifth embodiment is substantially similar to the spark plugs according to the above embodiments except for a powder filling so that the powder filling according to the fifth embodiment will be described hereinafter and other descriptions are simplified or omitted.

Figure 12A:
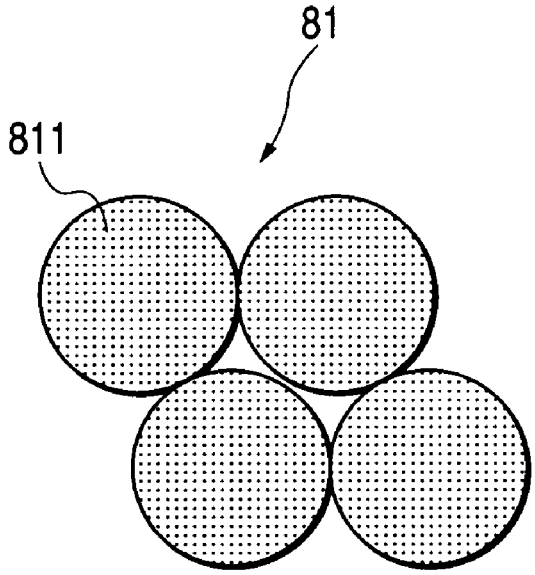
FIG. 12A is an enlarged view showing a part of a powder filling according to a fifth embodiment of the invention.

As shown in FIG. 12A, the powder filling 81 of the fifth embodiment is composed of primary non-granulated grains 811, referred to simply as "primary grains 811".

The powder filling 81 is composed of the primary grains 811. Each of the primary grains 811 has a substantially spherical shape, organic component less than 0.2 wt/% and pore rate which is not more than 2% so as to be dense.

The distribution of the grain diameters of the primary grains 811 is determined so that 80 wt % and over of the primary grains 811, before the powder filling 81 is filled, have grain diameters within the range from 100 to 100 $\mu$m, respectively.

Figure 12B:
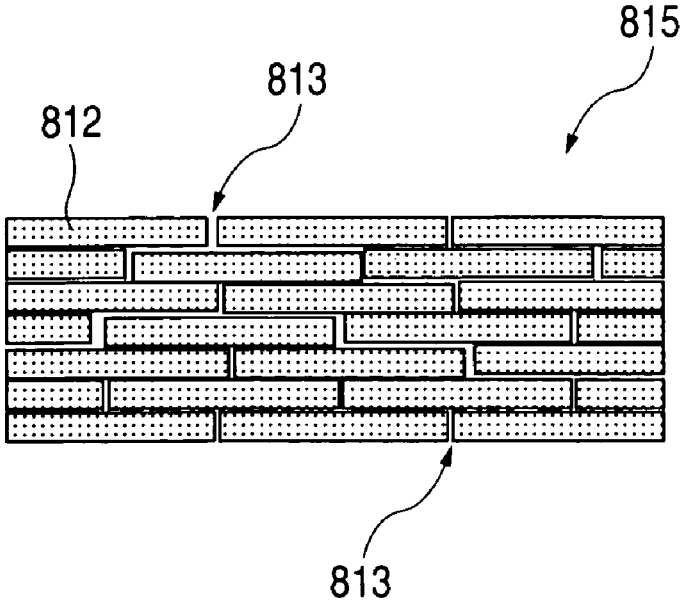
FIG. 12B is an enlarged view showing a part of a filled portion of a spark plug according to the fifth embodiment of the invention.

The powder filling 81 is filled in the annular space portion 6 of the spark plug 1 shown in FIG. 1 to be pressurized so that the primary grains 811 become configurations shown in FIG. 12B. That is, the primary grains 811 are lost flat to become scaled structures 812 so that the scaled structures 812 are laminated with each other. The laminated scaled structures 812 constitute a filled portion 815 of the spark plug.

Between the scaled structures 812, a narrow gap 813 having labyrinthine structure is formed because each of the primary grains 811 is non-granulated, hardly involves air and has low pore rate. The filled portion 815 hardly contains organic component so that the state of the gap 813 hardly vary with time.

In the spark plug according to the fifth embodiment, even when liquid component such as gasoline reaches to the filled portion 815, it takes a lot of time before the liquid component passes through the gap 813 so that components such as liquid, gas or the like hardly pass through the filled portion, allowing airtightness at the gap between the housing 5 and the insulator 4 to be kept sufficient.

When adding auxiliary filling described in the third embodiment to the powder filling 81, the auxiliary filling is adhered on the outer periphery of each of the primary grains 811 to be covered thereon so that the powder filling 81 is filled in the annular space portion 6 to be pressurized.

As a result, as shown in FIG. 12B, even though the primary grains 811 are lost flat to become the scaled structures 812, the auxiliary filling is inserted into the gap 813 formed between the scaled structures 812 so as to be filled therein. Therefore, adding the auxiliary filling allows the filled portion having further high airtightness to be obtained.

In contrast, a powder filling 82 composed of granulated grains 822 according to the related arts is explained.

Figure 13A:
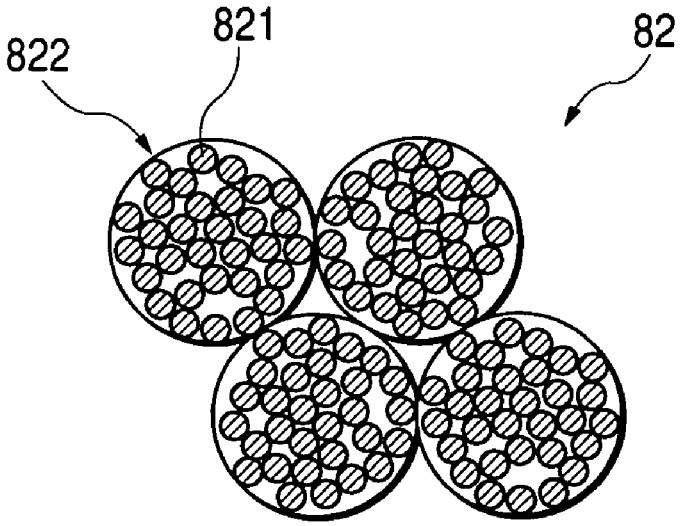
FIG. 13A is an enlarged view showing a part of a powder filling according to related arts.
Figure 13B:
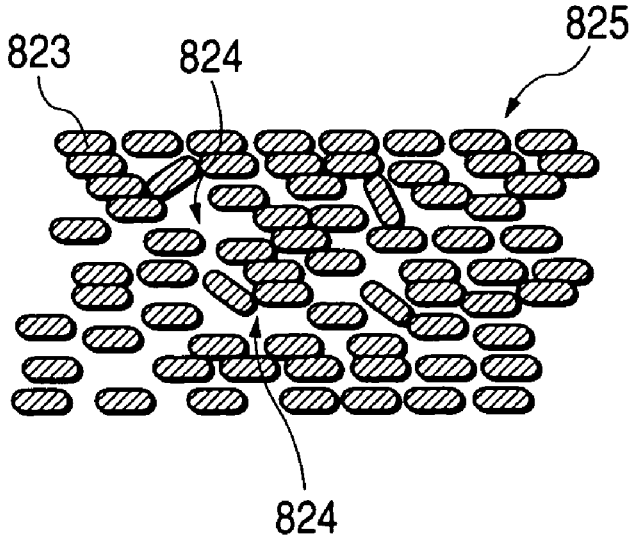
FIG. 13B is an enlarged view showing a part of a filled portion of a spark plug according to related arts.

As shown in FIG. 13A, the raw powder particles 821 are mixed to be granulated with air being involved, so that each of the granulated grains 822 forms a substantially porous shape.

When pressurizing the powder filling 82, the raw powder particles 821 are pressurized flat to become scaled structures 823 constituting a filled portion 825, similarly to the powder filling 82 shown in FIG. 12B. However, each of the scaled structures 823 is smaller than each of the scaled structures 812 in size, and each of the granulated grains 822 involves large amount of air so that a gap 824 between the scaled structures 823 is very large and a total density of the filled portion 825 is decreased.

Therefore, components such as liquid, gas or the like easily pass through the gap 824 of the filled portion 825, causing airtightness of the filled portion 825 to be decreased.

On the contrary, in the fifth embodiment of the present invention, as described above, it is possible to improve airtightness of the filled portion.

(Sixth Embodiment)

In this sixth embodiment, a spark plug of the sixth embodiment is substantially similar to the spark plugs according to the above embodiments except for a powder filling so that the powder filling according to the sixth embodiment will be described hereinafter and other descriptions are simplified or omitted.

Figure 14A:
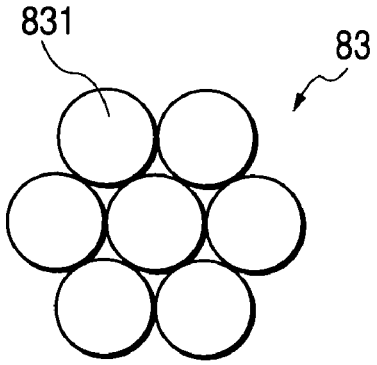
FIG. 14A is an enlarged view showing a part of a powder filling which has talc grains according to a sixth embodiment of the invention.

As shown in FIG. 14A, the powder filling 83 of the sixth embodiment is composed of talc grains 831.

When the powder filling 83 is filled in the annular space portion 6 of the spark plug to be pressurized, at a first stage, as shown in FIG. 14A, the talc grains 831 are laminated with each other in good order, that is, in closest filling (packing) so as to be shaped as substantially hexagonal shape.

Figure 14B:
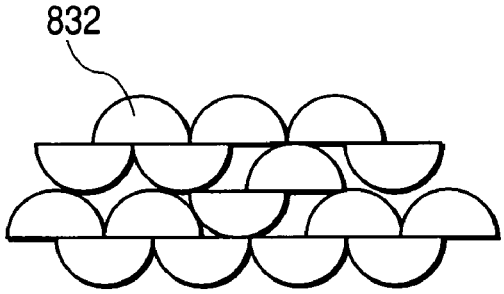
FIG. 14B is an explanation view showing a part of the powder filling which has broken talc grain particles according to the sixth embodiment of the invention.

Next, at a second stage, as shown in FIG. 14B, increasing the pressurizing force causes the talc grains 831 to be opened and broken so that the broken talc grain particles 832 are slide with each other.

Figure 14C:
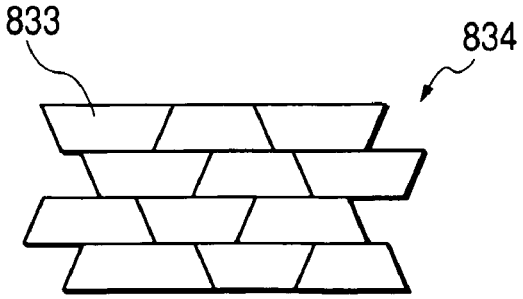
FIG. 14C is an enlarged view showing a part of a filled portion of a spark plug according to the sixth embodiment of the invention.

The broken talc grain particles 832 are further broken to become fine talc particles so that, in gaps between the broken talc grain particles 832, the fine talc particles are filled so that, at a final stage, as shown in FIG. 14C, a talc-filled portion 834 which is very dense is formed. Incidentally, a reference numeral 833 represents the broken talc grain particles 832.

As described above, using grains which can be easily lost, such as talc grains, as the component of the powder filling allows the filled portion having high airtightness to be obtained.

Incidentally, in usual powder forming, filling rate of each of grains in closest filling (packing) in the powder filling is substantially 74% so that it is difficult to obtain a dense filled portion having filling rate which is not less than the 74% unless each grain is broken.

In addition, there is known even if grains having different grain diameters are mixed to form a powder filling, filling rate of which is increased up to only 80%.

However, in the sixth embodiment, using the powder filling composed of the talc grains allows the filled portion having high filling rate of 95% to be obtained.

(Seventh Embodiment)

In this seventh embodiment, a spark plug 1*b* of the seventh embodiment is substantially similar to the spark plugs according to the above embodiments except for a structure of the filled portion so that the structure thereof according to the seventh embodiment will be described hereinafter and other descriptions are simplified or omitted.

Figure 15:
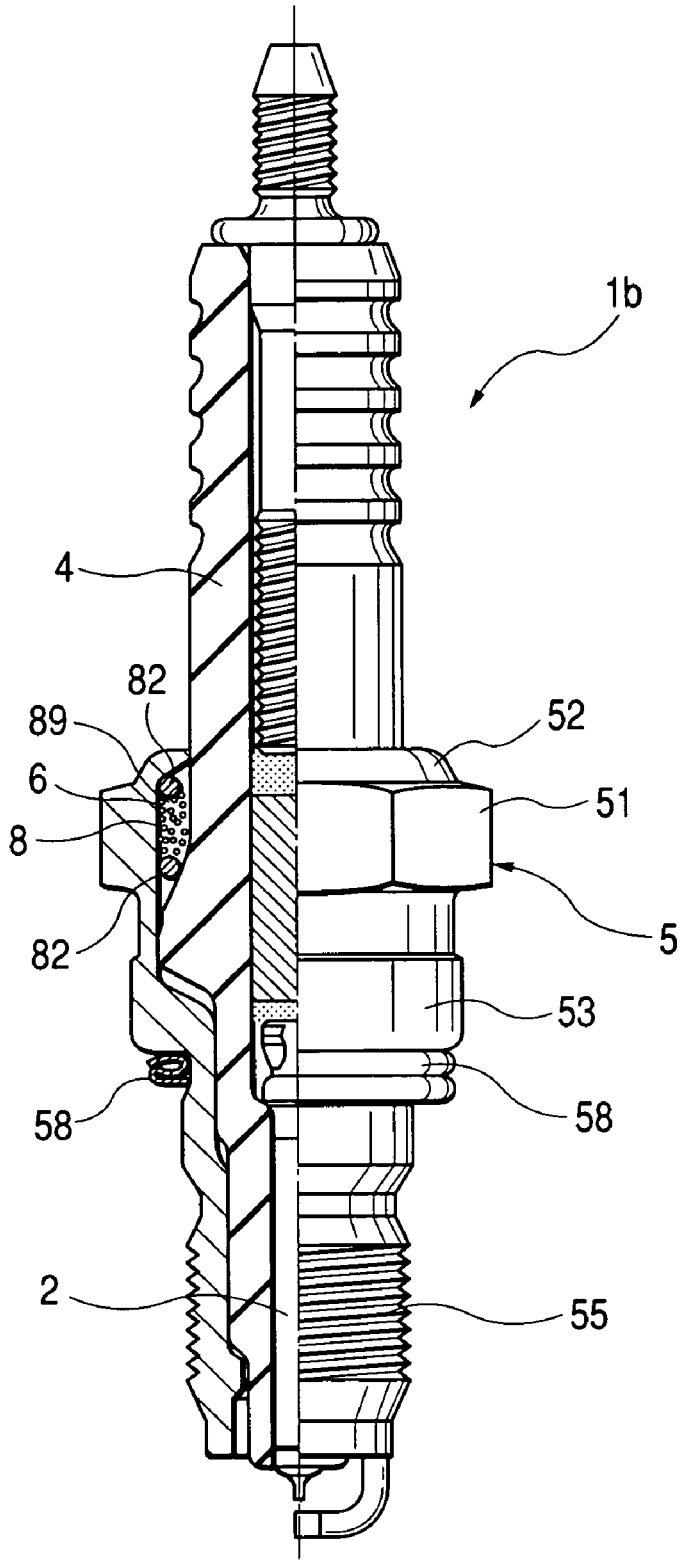
FIG. 15 is a semi-cross sectional view showing a spark plug according to a seventh embodiment of the invention.

As shown in FIG. 15, when filling the powder filling 82 in the annular space portion 6, the powder filling 82 is pressurized to be formed as a bulk body 89 having an annular shape corresponding to the annular space portion 6, and the bulk body 89 is filled between the upper ring member 82*a* and the lower ring member 82*b* to form the filled portion 8 therebetween.

That is, after forming the powder filling 82 into the bulk body 89, it is possible to easily fill the bulk body 89 into the annular space portion 6 of the spark plug 1*b*. Even though the forming process of the bulk body 89 is increased, because of saving a lot of labor, it is possible to increase a productivity of the spark plug 1*b*.

When the bulk body 89 has certain degree of high strength, it is possible to automatically fill the bulk body 89 into the annular space portion 6.

In addition, the insulator 4 is composed of, for example, burned ceramic, and has surface relative roughness which is poor. For example, surface relative roughness Rz equals to 20 $\mu$m. The poor surface relative roughness may cause the flowability of each of the grains to be inhibited, interrupting the forming of dense filled portion 8.

In this seventh embodiment, when the powder filling 80 is formed into the bulk body 89 and the bulk body 89 is filled into the annular space portion 6, it is possible to smoothly fill the bulk body 89 into the annular space portion 6 in spite of the powder flowability of the outer peripheral surface of the insulator 4. In addition, the powder filling 80 is formed by using a mold so that it is easy to secure a constant filing amount, a constant filling density and a predetermined size of the bulk body, respectively.

Incidentally, in the above embodiments and modifications, as the powder filling, any material, such as talc, boron nitride or the like may be used.

While there has been described what is at present considered to be the preferred embodiments and modifications of the present invention, it will be understood that various modifications which are not described yet may be made therein, and it is intended to cover in the appended claims all such modifications as fall within the true spirit and scope of the invention.

This application is based upon and claims the benefit of priority of the prior Japanese Patent Application 2002-9036 filed on Jan. 17, 2002 and Japanese Patent Application 2002-3355500 filed on Nov. 19, 2002, the contents of which are incorporated herein by reference.

What is claimed is:

1. A spark plug for an internal combustion engine, comprising:

an insulator provided at its inside with a center electrode;

a tubular housing disposed to surround an outer periphery of the insulator;

an annular space portion provided between the housing and the outer periphery of the insulator; and a powder filling filled in the annular space portion to be formed as a filled portion therein, said powder filling being composed of a plurality of non-granulated filling grains, 80 weight percent and over of said filling grains, before the powder filling is filled in the annular space, having a range from 210 to 710 $\mu$m in grain diameter, respectively.

2. A spark plug according to claim 1, wherein said powder filling contains organic component, an amount of said organic component contained in the powder filling being less than 0.2 weight percent.

3. A spark plug according to claim 1, wherein each of said filling grains has a pore rate, said pore rate being not more than 2%.

4. A spark plug according to claim 1, wherein said filled portion has a pore rate, said pore rate being not more than 6%.

5. A spark plug according to claim 1, wherein said filled portion has a pore rate, said pore rate being not more than 2%.

6. A spark plug according to claim 1, wherein said powder filling is formed as a bulk body, said bulk body having an annular shape corresponding to the annular space portion, and wherein said bulk body is filled in the annular space portion.

7. A spark plug according to claim 1, wherein said housing comprises a fitting portion having a tubular polygonal shape and surrounding the annular space portion, and wherein said fitting portion allows the spark plug to be rotated when fitting the spark plug, and is formed at its one end with a sleeve, said sleeve being caulked inwardly toward a center axis of the spark plug so as to hermetically close the filled portion.

8. A spark plug according to claim 1, further comprising a first ring member and a second ring member, said first ring member being disposed in one end of the annular space portion, said second ring member being disposed in other end thereof, said powder filling being filled between the first and second ring members in the annular space portion.

9. A spark plug for an internal combustion engine, comprising:

an insulator provided at its inside with a center electrode;

a tubular housing disposed to surround an outer periphery of the insulator;

an annular space portion provided between the housing and the outer periphery of the insulator; and a powder filling filled in the annular space portion so as to be formed as a filled portion therein, said powder filling containing an auxiliary filling added thereto, wherein said powder filling is composed of a plurality of non-granulated filling grains, 80 weight percent and over of said filling grains, before the powder filling is filled in the annular space, having a range from 210 to 710 $\mu$m in grain diameter, respectively.

10. A spark plug according to claim 9, wherein said auxiliary filling is composed of material containing crystal water or absorbed water.

11. A spark plug according to claim 9, wherein said auxiliary filling is composed of at least one of first aluminum phosphate ($Al_2O_3.3P_2O_5.6H_2O$), sodium silicate solution and potassium silicate solution.

12. A spark plug according to claim 9, wherein an amount of said auxiliary filling contained in the powder filling is a range from 0.1 to 5 w/t parts.

13. A spark plug according to claim 9, wherein said filled portion composed of the powder filling to which the auxiliary filling is added has a pore rate, said pore rate being not more than 6%.

14. A spark plug according to claim 9, wherein said filled portion composed of the powder filling to which the auxiliary filling is added has a pore rate, said pore rate being not more than 2%.

15. A spark plug according to claim 9, wherein said housing comprises a fitting portion having a tubular polygonal shape and surrounding the annular space portion, and wherein said fitting portion allows the spark plug to be rotated when fitting the spark plug, and is formed at its one end with a sleeve, said sleeve being caulked inwardly toward a center axis of the spark plug so as to hermetically close the filled portion.

16. A spark plug according to claim 9, further comprising a first ring member and a second ring member, said first ring member being disposed in one end of the annular space portion, said second ring member being disposed in other end thereof, said powder filling to which the auxiliary filling is added being filled between the first and second ring members in the annular space portion.

* * * * *